US005135166A

United States Patent [19]

Dietiker et al.

[11] Patent Number: 5,135,166

[45] Date of Patent: Aug. 4, 1992

[54] HIGH-VELOCITY THERMAL SPRAY APPARATUS

[75] Inventors: Markus Dietiker, Aarau; Andreas Bachmann, Beinwil, both of Switzerland

[73] Assignee: Plasma-Technik AG, Switzerland

[21] Appl. No.: 697,052

[22] Filed: May 8, 1991

[51] Int. Cl.[5] ..... B05B 1/24; B05C 5/04

[52] U.S. Cl. ..... 239/8; 239/13; 239/79; 239/85

[58] Field of Search ..... 239/8, 13, 79, 81, 85

[56] References Cited

U.S. PATENT DOCUMENTS

| | | | |
|---|---|---|---|
| 2,125,764 | 8/1938 | Benoit | 91/12.2 |
| 2,436,335 | 12/1943 | Simonsen | 91/12.2 |
| 2,544,259 | 11/1944 | Duccini et al. | 91/12.2 |
| 2,643,955 | 8/1950 | Powers et al. | 117/21 |
| 2,804,337 | 8/1957 | Marantz | 299/28.7 |
| 2,861,999 | 11/1958 | Smith et al. | 117/105 |
| 3,304,402 | 2/1967 | Thorpe | 219/76 |
| 3,460,764 | 8/1967 | Wallis | 239/422 |
| 4,121,082 | 10/1978 | Harrington et al. | 219/75 |
| 4,121,083 | 10/1978 | Smyth | 219/76.16 |
| 4,302,483 | 11/1981 | Altorfer | 427/37 |
| 4,358,053 | 11/1982 | Ingham et al. | 239/79 |
| 4,368,846 | 1/1983 | Raue et al. | 239/85 |
| 4,562,961 | 1/1986 | Guenard | 239/79 |
| 4,569,479 | 2/1986 | Suwa | 239/79 |
| 4,632,309 | 12/1986 | Reimer | 239/8 |
| 4,865,252 | 9/1989 | Rotolico et al. | 239/8 |
| 4,964,568 | 10/1990 | Rotolico et al. | 239/8 |
| 5,014,916 | 5/1991 | Trapani et al. | 239/79 |
| 5,019,686 | 5/1991 | Marantz | 219/76.14 |

*Primary Examiner*—Andres Kashnikow
*Assistant Examiner*—Lesley D. Morris
*Attorney, Agent, or Firm*—Dykema Gossett

[57] ABSTRACT

A thermal spray gun having an advanced, streamlined design which simplifies assembly of the gun components and reduces maintenance downtime. The thermal spray gun has a fuel/oxidant gas nozzle with a plurality of oxygen outlets arranged in a ring upon a discharge face. Three alternative fuel gas outlet configurations provide a combustion flame within a barrel having an inlet adjacent the fuel/oxidant gas nozzle discharge face. Powdered feedstock is supplied through a centrally disposed feedstock injector and is heated by the combustion flame. Oxidant gas, fuel gas and power feedstock are simultaneously discharged into the barrel, through a single plane perpendicular to the direction of gas and feedstock flow.

18 Claims, 5 Drawing Sheets

HIGH-VELOCITY THERMAL SPRAY APPARATUS

TECHNICAL FIELD

The present invention relates generally to the field of flame spray methods and apparatus. More specifically, the present invention provides flame spray guns which produce high-quality coatings using a wide variety of feedstocks. The novel spray guns of this invention have an advanced, streamlined design which simplifies assembly of the gun components and reduces maintenance downtime. A method of forming a flame spray coating with the novel flame spray guns is also provided.

BACKGROUND OF THE INVENTION

Flame spraying has become the preferred process in a number of applications, particularly in the field of high-performance coatings. In general, flame spray technology relies on the use of specially designed spray guns which project a stream of high-temperature particles onto the surface of a substrate. A number of materials have been successfully flame sprayed, including metals, oxides, and cermets, as well as some glasses and plastics. Depending upon the spray gun design, the feedstock can be supplied as a powder, wire, or rod or as combination of these forms. Where a powdered feedstock is used, the powder is typically held in a hopper and is fed to the spray gun by gravity feed or, more preferably, by a carrier gas.

In operation, the feedstock is metered into the spray gun where it is heated and accelerated to form a particle stream having sufficient thermal and kinetic energy to form a dense, adherent coating on a preselected substrate. Heat is produced by combustion of a fuel gas. In one type of spray gun, fuel and oxygen streams combine to form a flame front in coaxial relation with the incoming feedstock stream. As the solid feedstock enters the high-temperature combustion flame, it is heated (and atomized where a non-particulate feedstock is used) to a temperature within a preselected temperature range.

A number of factors determine feedstock temperature, including residence time of the particles in the flame and flame temperature. In most applications, the feedstock particles must be melted or at least softened by the flame. A uniform temperature profile is desired, since inclusions of unmelted particles in the resultant coating may seriously reduce durability of the coating.

In addition to supplying heat to the feedstock, the combustion gases provide the force necessary to accelerate the molten feedstock particles to the high-velocities which are required to form high-quality coatings. In a number of spray guns, combustion occurs within a combustion chamber in the gun body. As the high-temperature combustion gases expand, they are directed through a spray nozzle to form a stream of high-velocity gas which accelerates the molten particles to velocities which may exceed twenty-five hundred feet per second. If particle velocity is too low, inferior coatings may be produced due to low impact forces by the particles on the substrate. Unwanted volitilization of the feedstock may also occur due to excessive residence time of the particles in the high-temperature region of the gun.

Upon impact, the high-velocity softened or molten particles impinge on the substrate and flatten to form thin platelets of material that conform to the substrate surface. The individual "splats" adhere to one another and form a mechanical and, often, a metallurgical bond with the substrate material. The deposited material then solidifies rapidly, forming a dense adherent coating.

Therefore, two fundamental performance requirements of any flame spray gun are the ability to provide requisite but not excessive particle temperature and the capacity to produce a minimum particle velocity to form high-density coatings. In addition, however, a performance requirement which has often been overlooked in conventional flame spray gun designs is the need for durability and simplicity of the gun. Although a number of flame spray gun prototypes may be capable of producing high-quality coatings under laboratory test conditions, the overall design of these guns may be such that they require constant calibration and maintenance. Moreover, a design which works well as a prototype that is machined and assembled by a skilled craftsman and may be difficult to produce on a large-scale basis. In particular, tolerances which can be met in the assembly of a prototype may be too restrictive in a production environment, resulting in a product which does not reliably reproduce the coatings obtained in prototype testing.

The present invention addresses these concerns by providing a flame spray gun which is unique in design and which can be easily manufactured and maintained—without sacrificing particle temperature and velocity control necessary to produce high-quality coatings.

By way of a survey of conventional flame spray guns, numerous guns have been identified in the patent literature. That of U.S. Pat. No. 4,416,421 is described as an "Ultra High-Velocity Flame Spray Apparatus" and includes a combustion chamber in which oxygen and a fuel gas are premixed and combusted to form combustion gases. The combustion gases are discharged through a nozzle. A feedstock is introduced at or upstream of the throat of an extended length nozzle. It is stated that the length of the nozzle bore should be substantially greater than the minimum diameter of the bore and that the pressure within the combustion chamber should be maintained at 75 PSIG or greater.

In U.S. Pat. No. 4,836,477, a relatively small diameter oxidizer inlet bore leads to a diverging conical diffuser which in turn leads to and merges with a larger diameter bore section. The large diameter bore defines a flame spray duct. It is claimed that the design allows all flow trajectories to pass in parallel through the duct bore, eliminating flow recirculation and particle recirculation. In U.S. Pat. No. 1,930,373, a spray gun is described in which concentric annuli are used to form a concial flame within a truncated gun nozzle. A feedstock is introduced into the flame axially through a central bore in the gun body.

In U.S. Pat. No. 2,125,764, a spray apparatus is disclosed in which jets of compressed air flow in the form of a ring around a flame and serve to propel powder. Powder is carried in a central passage through the body of the apparatus. U.S. Pat. No. 2,804,337 discloses a spray apparatus having a portion which includes a plurality of gas outlets surrounding a central bore through which particles are conveyed. In U.S. Pat. No. 4,302,483,a spray apparatus is disclosed in which gases are conveyed in concentric annuli around an axial feedstock bore.

In U.S. Pat No. 4,562,961, a gunitting nozzle end piece is disclosed which includes a plurality of individual tubes disposed in ring-like fashion around an internal ring comprised of a second set of tubes. A refractory powder is carried through at least one set of the plurality of tubes. U.S. Pat. No. 4,634,611 discloses a flame spray apparatus wherein an oxygen and fuel gas mixture is ignited in a straight bore combustion throat into which a feedstock is added through an axial bore.

SUMMARY OF THE INVENTION

In one aspect, the present invention provides a flame spray gun having a gun body which defines a generally centralized bore, a first passage for fuel gas flow, and a second passage for oxidant gas flow. A first manifold is provided for the substantially equal distribution of fuel gas from the fuel gas passage to a series of spaced fuel gas outlets arranged in a ring on the discharge face of a combined fuel-oxidant gas nozzle which is housed in the gun body bore. A second manifold is provided for the substantially equal distribution of oxidant gas from the oxidant gas passage to a series of spaced oxidant gas outlets arranged in a ring on the discharge face of the combined fuel-oxidant gas nozzle, in alternating position with the fuel gas outlets. A barrel is disposed in the gun body bore in axial relation with the face of the combined fuel-oxidant gas nozzle such that fuel and oxidant gases flowing from their respective outlets are discharged into the bore of the barrel. Nested within a central longitudinal bore defined by the combined fuel-oxidant gas nozzle is a powder injector assembly which defines a generally centrally disposed feedstock passage that terminates at an outlet generally coplaner with the face of the gas nozzle. In one preferred embodiment, the geometric center of each oxidant gas outlet on the discharge face of the combined fuel oxidant gas nozzle is displaced outwardly from the geometric center of each fuel gas outlet.

In another aspect, the fuel gas passages which terminate as outlets on the face of the combined fuel-oxidant gas nozzle are formed as notches or channels extending radially from the perimeter of the inner wall of the fuel-oxidant gas nozzle co-extensive with a portion of the central bore. Insertion of the powder injector assembly into the bore of the fuel-oxidant gas nozzle serves to close the channels along the bore thus providing separate passages for the flow of gas.

In still another aspect, a single annular fuel gas passage is provided which terminates on the face of the combined fuel-oxidant gas nozzle as a ring. The annular passage is defined by a recessed portion of the inner wall of the fuel-oxidant gas nozzle and a portion of the powder injector assembly.

A series of coolant passages are also provided throughout the gun body to dissipate heat produced by fuel combustion.

In still another aspect, the present invention provides a method of flame spraying a material which includes the steps of introducing at a single plane a fuel gas, an oxidant gas and a particulate feedstock to form a combustion flame in generally co-axial arrangement around a central stream of particulate feedstock. Combustion gases are expanded in a barrel, one end of which is adjacent this single plane. The combustion gases and the heated, accelerated feedstock particles pass through the barrel to issue as a high-velocity stream of combustion gas with entrained molten or softened feedstock particles. The stream of molten or softened particles is then directed to a substrate to form a coating.

These and other objects, features and advantages of the invention will now be described with reference to the following drawings, in which:

DETAILED DESCRIPTION OF THE PREFERRED EMBODIMENT

Figure 1:
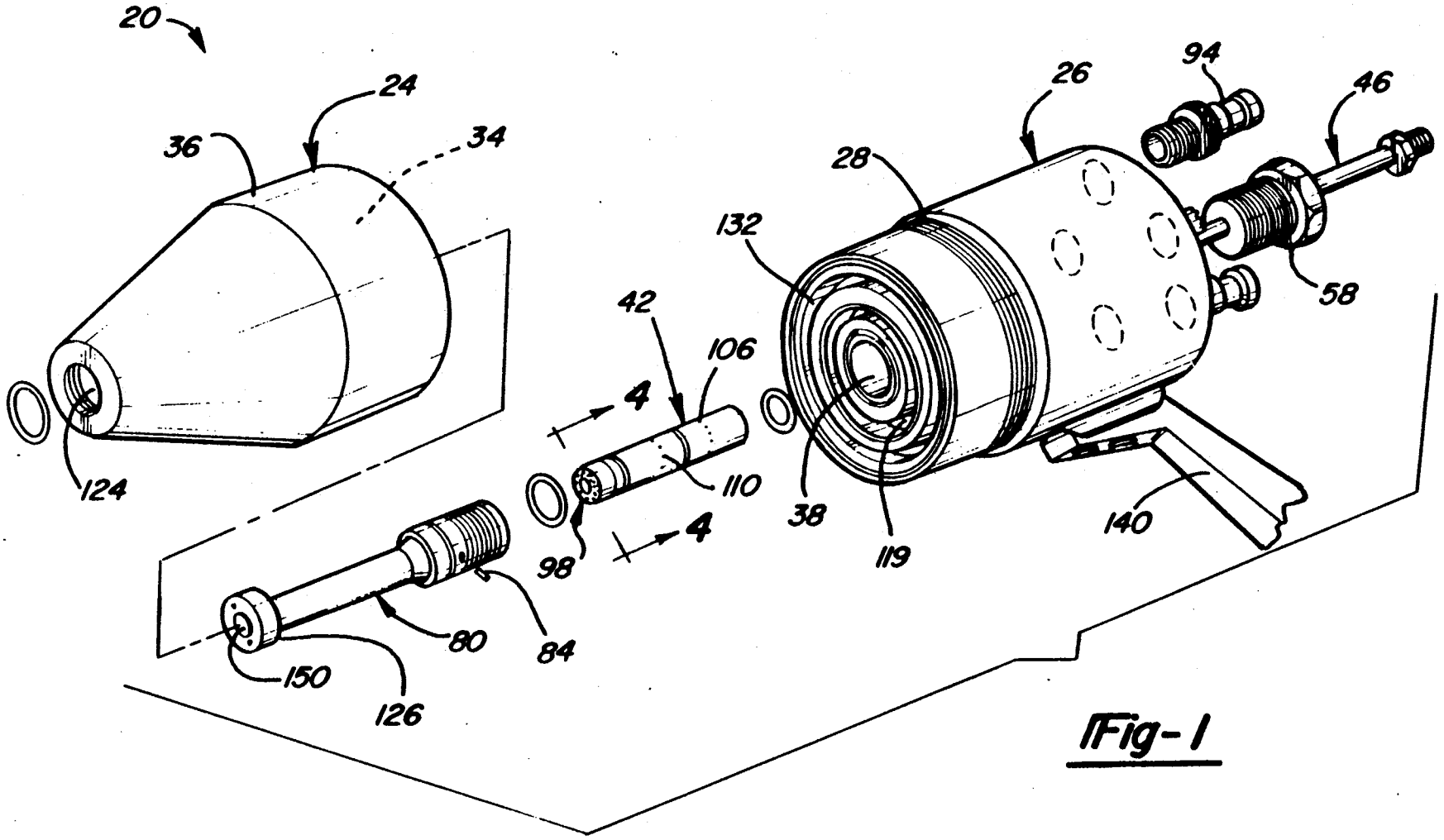
FIG. 1 is an exploded view of the flame spray gun of the present invention mounted on a spray gun bracket.
Figure 2:
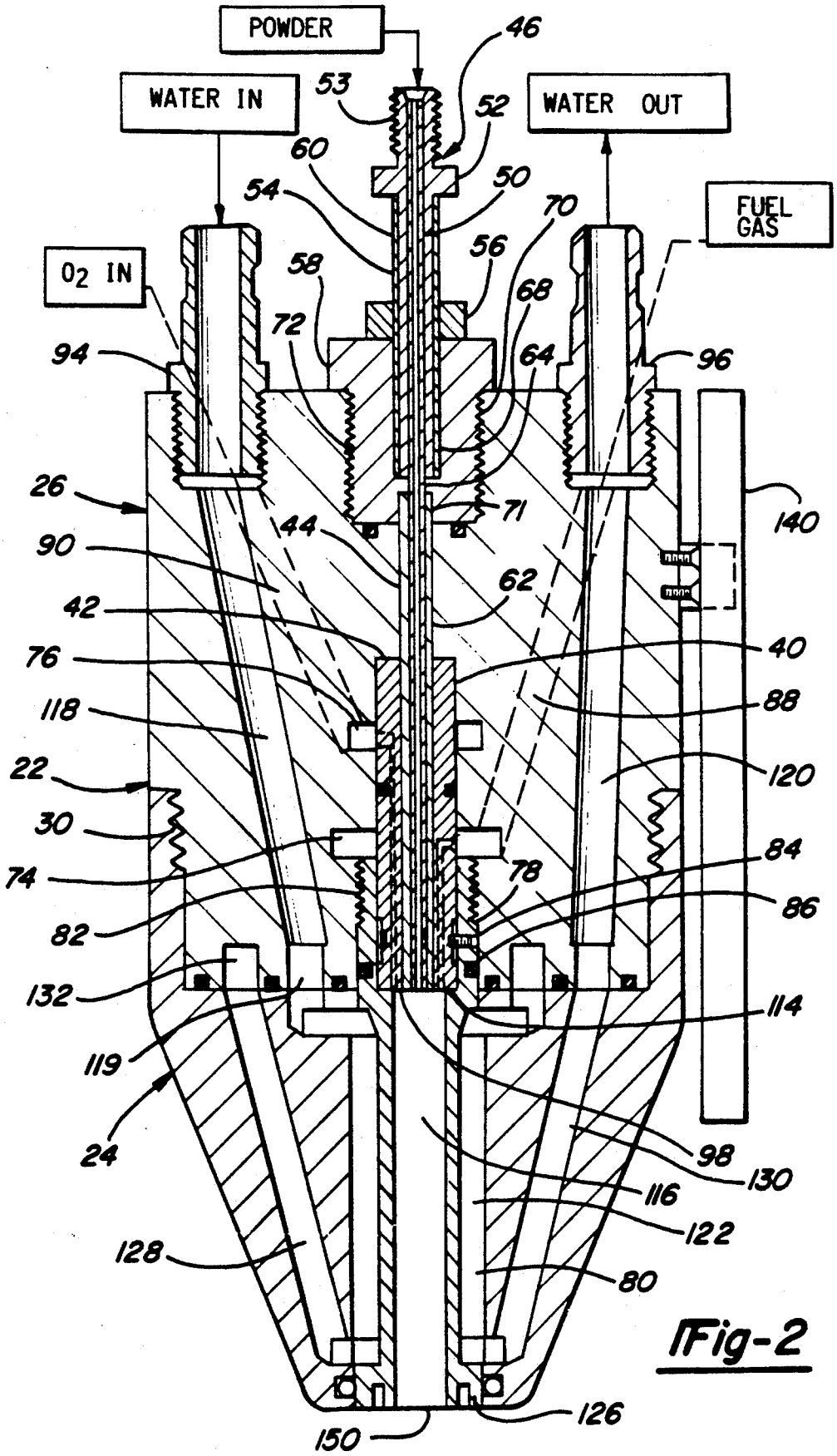
FIG. 2 is a side elevational view of the spray gun of the present invention in cross-section along line 2—2 of FIG. 3.

Referring now to FIGS. 1 and 2 of the drawings, flame spray gun 20 is shown generally having a gun body 22 which consists of a front body portion 24 and a gas or rear body portion 26. A portion of gas body 26 includes threads 28 which receive corresponding threads 30 of front body 24. Thus, it will be appreciated that front body 24, which is in the shape of a cone, can simply be screwed onto gas body 26. Reduced diameter front portion 32 of gas body 26 is closely received within cavity 34 defined by partially threaded collar portion 36 of front body 24. As will be explained more fully hereinafter, this two-piece body construction allows flame spray gun 20 to be easily manufactured and assembled as well as easily disassembled for maintenance purposes. Also, it is to be understood throughout this description that any number of materials may be used to fabricate the various components such as brass, steel and the like.

Gas body 26 has a central or main bore 38 having a first or enlarged portion 40 which receives combined fuel-oxidant gas nozzle 42 and a second portion 44 which receives feedstock delivery tube assembly 46. Combined fuel-oxidant gas nozzle 42 also defines a bore or feedstock injector assembly-receiving bore 48 into which one end of feedstock delivery tube or injector assembly 46 is engaged. Feedstock delivery tube assembly 46 includes a continuous powder tube 50 and provides a passage for a particulate feedstock through gas body 26. Collar 52 and threads 53 are provided for connection with a hose to deliver feedstock powder from a powder supply hopper or the like to feedstock delivery tube assembly 46. Sheath 54 is shown along with collar 56 integral with threaded plug 58, sheath 54 and collar 52, although in a preferred embodiment collar 56 screws into plug 58 to allow powder tubes of various diameters to be utilized interchangeably. In some applications, powder tube 50 may be releasably engaged in tube assembly 46 for easy replacement when worn. Thus, feedstock delivery tube assembly 46 includes a body portion 60 which is threaded at one end, a collar portion 52 and is surrounded by a sheath 54. A second body portion 62 is also provided which is closely received within feedstock tube receiving portion 44 of central bore 38 and through which powder tube 50 extends. Plug 58, therefore, includes a continuous bore 64 having a first portion 68 which is enlarged to receive first body portion 60 and sheath 54 of feedstock delivery tube assembly 46 and a second portion 71 which closely receives a second body portion 62 of feedstock delivery tube assembly 46. Since alignment of the various parts is important to proper functioning, it is important that these components fit together tightly. It will now be appreciated that central bore 38 contains three sections or portions of different diameters, first portion 40, second portion 44, and a third plug receiving portion 70, the latter of which is threaded to receive threads 72 of plug 58. In this particular embodiment, body portion 62 mates with the inner wall of combined fuel-oxidant gas nozzle 42.

One of the important features of the present invention is the delivery of a constant, steady flow of fuel gas and oxidant gas to and through combined fuel-oxidant gas nozzle 42. This is achieved in the present invention by providing a fuel gas manifold 74 and an oxidant gas manifold 76. Fuel gas manifold 74 and oxidant gas manifold 76 are, in essence, ring like extensions of enlarged portion 40 of central bore 38 of gas body 26. In more detail, enlarged portion 40 of central bore 38 comprises an end portion or opening 78 which, as will be explained more fully, receives barrel 80 by virtue of its threaded end 82 adjacent opening 78. Fuel gas manifold 74 is shown which forms an annular space or ring around combined fuel-oxidant gas nozzle 42. In like manner, oxidant gas manifold 76 forms a ring around combined fuel-oxidant gas nozzle 42. Combined fuel-oxidant gas nozzle 42 thus extends and is closely received within threaded end 82 of barrel structure 80. Set screw 84 is provided to secure combined fuel-oxidant gas nozzle 42 within threaded end 82 of barrel structure 80. During assembly, combined fuel-oxidant gas nozzle 42 is inserted into threaded end 82 of barrel structure 80, set screw 84 is secured and the resulting structure, i.e. barrel structure 80 within combined fuel-oxidant gas nozzle 42, is screwed into central bore 38. O-ring 86 is also provided to insure a solid friction fit. Multiple O-rings are also provided to secure combined fuel-oxidant gas nozzle 42 in place.

In order to supply gases to fuel gas manifold 74 and oxidant gas manifold 76, fuel gas passage 88 and oxidant gas passage 90 are provided in gas body 26. These passages are threaded at their openings to receive gas connectors (not shown) which may be of the same construction as coolant connectors 94 and 96. In addition, as shown in FIG. 1 of the drawings, an additional gas passage may be provided for the flow of nitrogen or the like. This feature allows nitrogen to be used to dilute the fuel gas and, therefore, this optional passage leads to fuel gas manifold 74.

Figure 5:
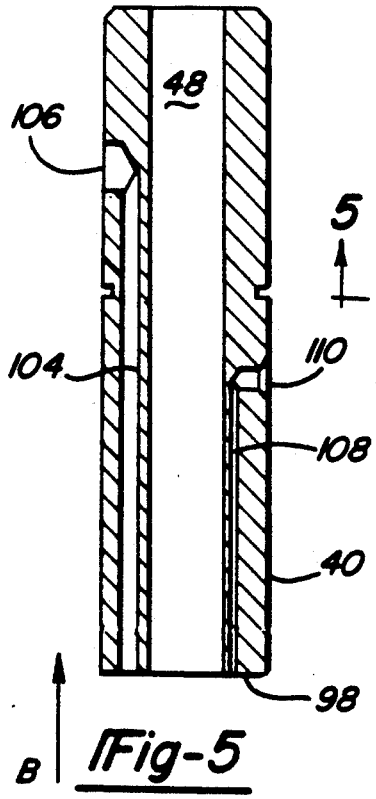
FIG. 5 is a cross-section of the combined fuel-oxidant nozzle along lines 5—5 of FIG. 4.

One of the key features of the present invention is the formation of discrete, radially separated flame fronts at discharge face 98 of combined fuel-oxidant gas nozzle 42. It has been found that the strategic placement of oxidant outlets 100 and fuel gas outlets 102 provides near stoichiometric combustion which reduces carbon buildup in barrel 80 as well as achieves uniform particle heating and high particle velocities produced in the present invention. More specifically, and referring now to FIGS. 4 and 5 of the drawings, combined fuel-oxidant gas nozzle 42 is shown in FIG. 5 having a central bore 48 which closely receives a portion of feedstock delivery tube assembly 46 as previously described. In addition, combined fuel-oxidant gas nozzle 42 is provided with a series of gas passages which receive gas from manifolds 74 and 76 and which discharge gas through outlets 100 and 102. Accordingly, a ring of microbores 104 are drilled through planar discharge face 98 of combined fuel-oxidant gas nozzle 42 and extend through the body of combined fuel-oxidant gas nozzle 42 as shown best in FIG. 5. These passages extended from outlets 100 to perpendicular bores or inlets 106. Inlets 106, passages 104 and outlets 100 thus form continuous individual separate fuel gas passages through combined fuel-oxidant gas nozzle 42. In the same manner, microbores 108 extend from outlets 102 through combined fuel-oxidant gas nozzle 42 to inlet 110. It can be seen, then, in FIG. 1 that inlets 110 form a first discontinuous ring around the perimeter of combined fuel-oxidant gas nozzle 42 and that inlets 106 define a second discontinuous ring around the perimeter of combined fuel-oxidant gas nozzle 42. These gas inlet rings are positioned in central bore 38 such that they are flow communication respectively, with fuel gas manifold 74 and oxidant gas manifolds 76.

Figure 4:
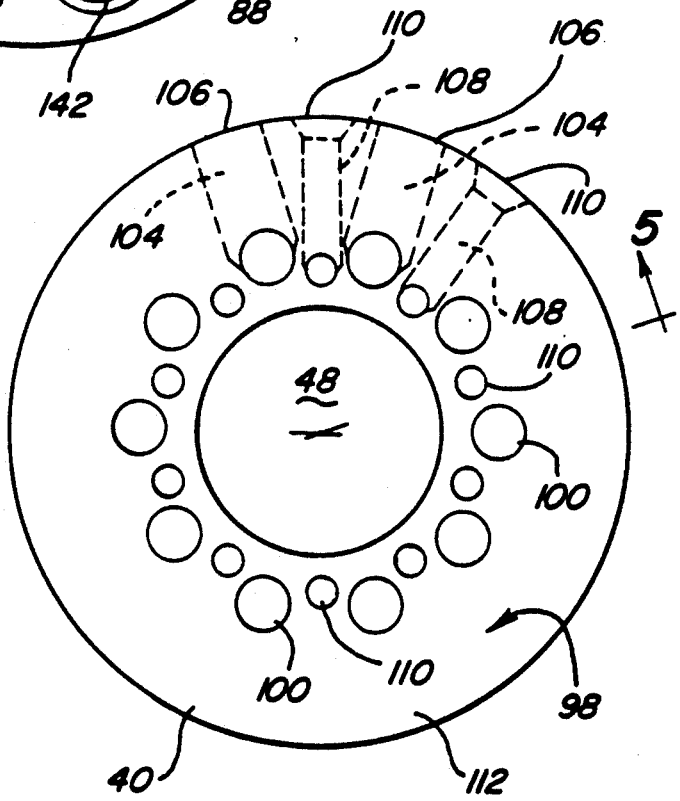
FIG. 4 is an end view of the combined fuel-oxidant nozzle depicted in FIG. 5 in the direction of arrow B.

As stated, and referring now specifically to FIG. 4 of the drawings, in the preferred embodiment of the invention, it has been found that the strategic alternating arrangement of outlets 100 and 102 provides excellent results in terms of combustion of the fuel and oxidant gases, which in turn provides optimum particle heating and acceleration characteristics. In terms of the placement of outlets 100 and 102, in a preferred embodiment they alternate as shown with the ring of centers, i.e. the ring formed by the geometric centers of oxygen outlets 100, outwardly displaced from the ring of centers of the fuel gas outlets 102, but such that a circle can be drawn which intersects all of the outlets. In other words, a single circle can be drawn which passes through all oxidant gas outlets 100 and all fuel gas outlets 102, but not through their geometric centers. It is preferred that the diameter of oxidant outlets 100 be approximately 4 times that of the diameter of fuel gas outlets 102. Discharge face 98 of combined fuel-oxidant gas nozzle 42, along with the placement of outlets 100 and 102, defines an outer region 112 which engages annular shoulder 114 of barrel structure 80. Thus, outlets 100 and 102 are unrestricted and may discharge fuel and oxidant gas directly into passage 116 of barrel 80. Combustion, therefore, takes place in passage 116 of barrel 80.

Figure 7:
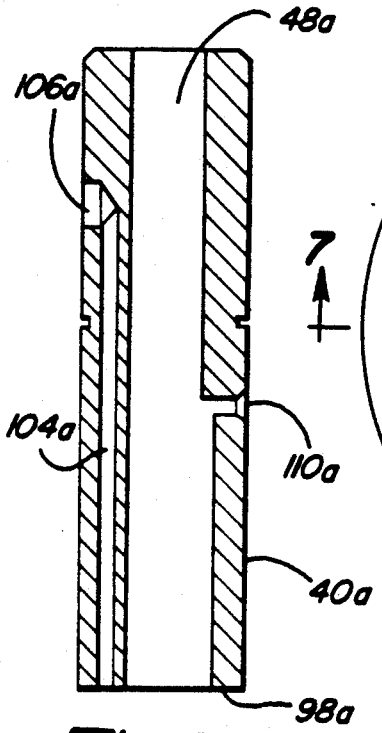
FIG. 7 is a cross-section of the combined fuel-oxidant nozzle along lines 6—6 of FIG. 6.
Figure 6:
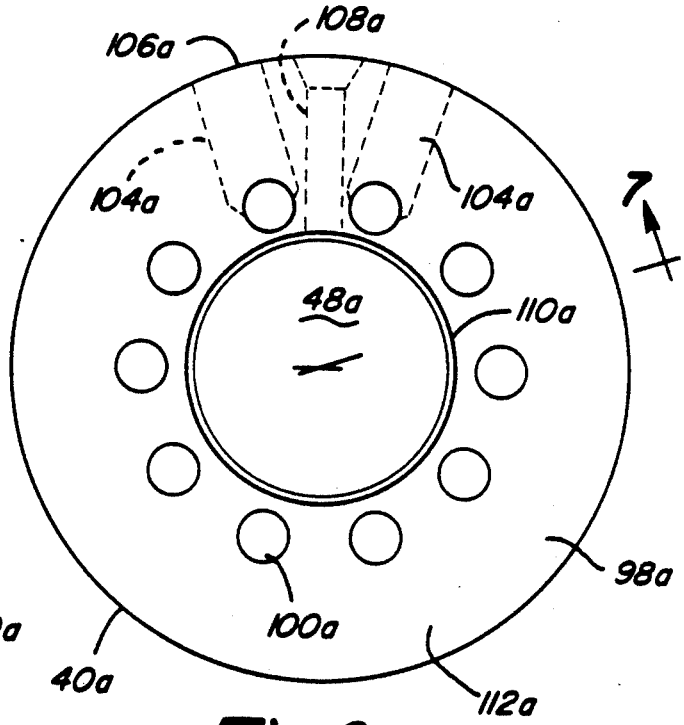
FIG. 6 is an end view of the combined fuel-oxidant nozzle depicted in FIG. 7 in the direction of arrow C.

In another embodiment of the present invention, and referring now to FIGS. 6 and 7, combined fuel-oxidant gas nozzle **42*a* has a somewhat different configuration than that shown in the previous figures. More specifically, combined fuel-oxidant gas nozzle 42*a* is formed such that bore 48*a* has two portions of different diameters x and y. That portion of combined fuel-oxidant gas nozzle 42*a* extending from inlet 110*a* to discharge face 98*a* is machined to provide a bore approximately 2 to 15 percent larger than the upstream portion of bore 48*a*. That is, y is most preferably about 8 percent greater than x. As shown best in FIG. 10, the placement of feedstock delivery tube assembly 46 defines one wall of annulus 108*a* while the inner surface of combined fuel-gas 42*a* forms the other wall of the annulus. This results in a continuous ring outlet 102*a* on discharge face 98*a* as shown in FIG. 6. Fuel gas from a single inlet 110a or multiple inlets is sufficient to produce uniform flow of fuel gas from outlet 102a into passage 116**.

Figure 9:
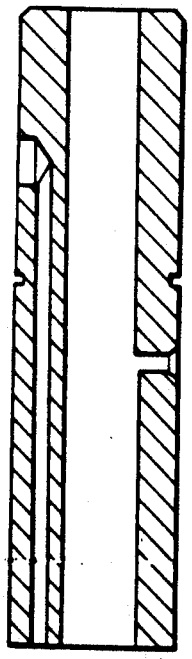
FIG. 9 is a cross-section of the combined fuel-oxidant nozzle along lines 8—8 of FIG. 8.
Figure 8:
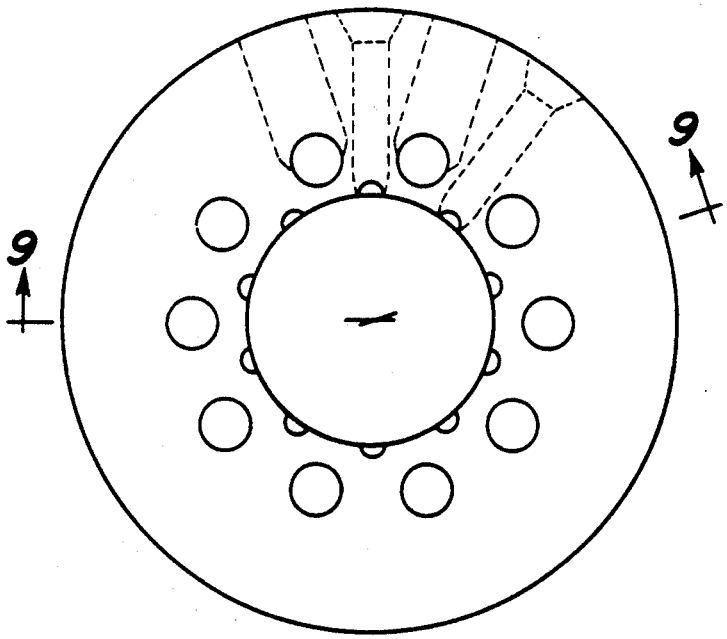
FIG. 8 is an end view of the combined fuel-oxidant nozzle depicted in FIG. 9 in the direction of arrow D.

In still another embodiment, and referring now to FIGS. 8 and 9 of the drawings, combined fuel-oxidant gas nozzle 42b has yet another preferred configuration. More specifically, combined fuel-oxidant gas nozzle 42b has a plurality of channels 108b which terminate on discharge face 98b as semi-circular outlets 102b. The precise geometry of outlets 102b is not deemed critical at this time, but is a function of the depth to which channels 108b are cut into the inner wall of combined fuel-oxidant gas nozzle 42b. Thus, a plurality of generally equally spaced channels are formed in the inner wall surface of combined fuel-oxidant gas nozzle 42b which extend from discharge face 98b to each inlet 110b. The depth of each channel 108b is preferably from approximately from about 0.2 mm to about 0.5 mm. The placement of feedstock delivery tube assembly 46 in effect closes each channel 108b along the length of body portion 62 thus forming discrete gas passages similar to microbores 108.

In order to dissipate the intense heat generated during flame spraying, a series of coolant passages are defined by gas body 26 and front body 24 as follows. Coolant passage 118 extends from coolant connector 94 to a coolant annulus 119. Coolant circulates in annulus 119 and passes through barrel coolant annulus 122 which is defined by the placement of barrel structure 80 in bore 124 of front body 24. It is to be noted that barrel structure 80 has an expanded end portion 126 which is closely received and mates with front body 24, which is best shown in FIG. 2. Coolant then moves through passages 128 and 130 to a second coolant annulus 132 and in gas body 26. Heated coolant is discharged through coolant discharge passage 120 via coolant outlet connector 96. The various ports for the gas and coolant connectors are best seen in FIG. 3.

Figure 10:
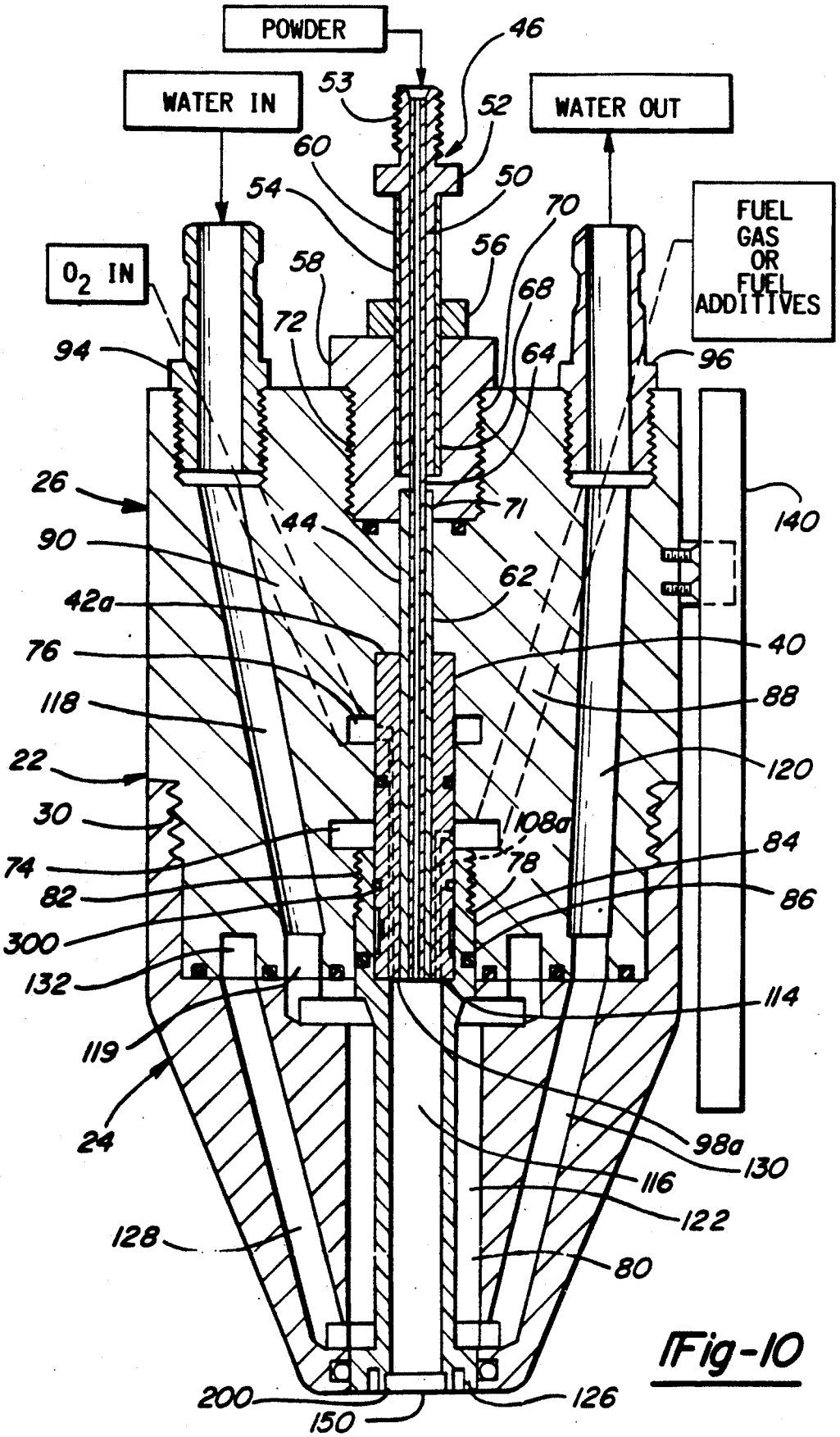
FIG. 10 is a side elevational view of the spray gun of FIG. 1 in cross-section with the combined fuel-oxidant nozzle of FIG. 9 and 10.

In still another embodiment, as shown in FIG. 10, the discharge end of barrel 80 is modified to produce a larger diameter bore 200 which is preferably about 5 to about 25 percent larger than the remainder of the bore, i.e., the discharge end is enlarged relative to the rest of the barrel bore. The length of this enlarged portion is typically from about ⅛ inch to ¾ inch. It has been found that large diameter bore portion 200 reduces spitting which may otherwise interfere with the production of high-quality coatings. Rather than a set screw, fuel-oxidant gas nozzle is stabilized by O-ring 300.

In addition to the structures described above, various O-rings are provided in order to seal and secure the spray gun components. Also, where it is desired to mount flame spray gun 20, bracket 140 is provided.

Figure 3:
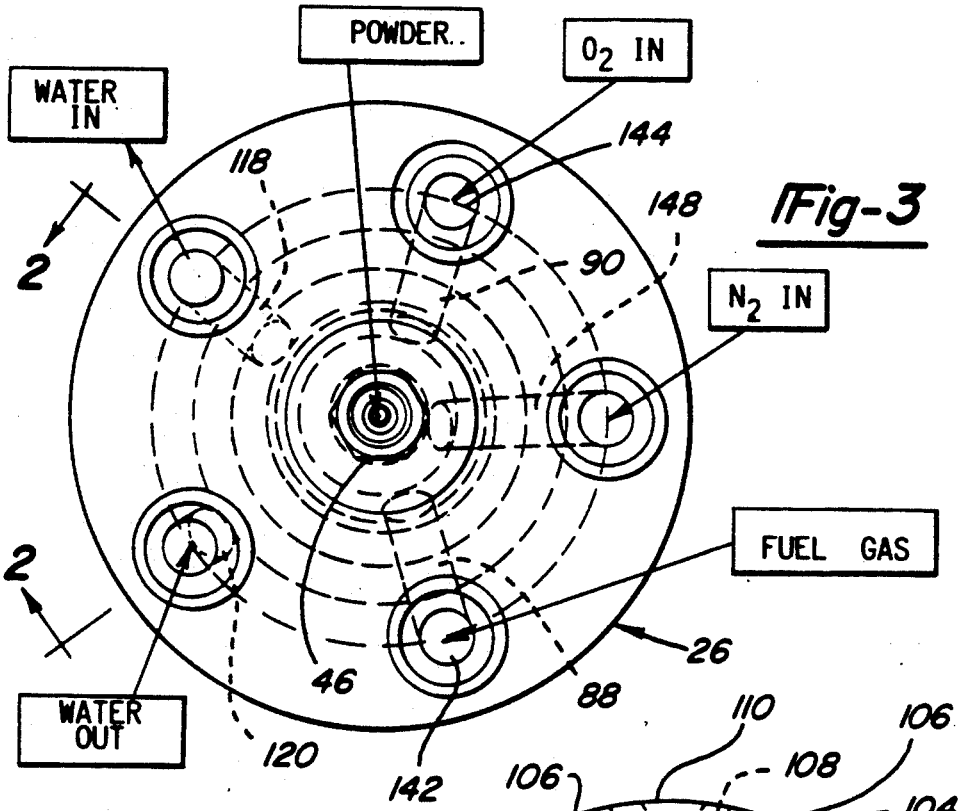
FIG. 3 is an end view of the spray gun depicted in FIG. 1 in the direction of arrow A.

In operation, and referring to FIGS. 1 and 2 as illustrative, a fuel gas, preferably propylene, is supplied from a fuel gas source (not shown) which is connected to fuel gas connector at port 142 shown in FIG. 3 of the drawings. Similarly, an oxidant gas, preferably oxygen, is provided from a suitable source (not shown) at oxidant gas port 144. As stated, in some applications a third gas such as nitrogen, may be supplied through optional passage 146 via port 148.

Oxygen is flowed through passage 90 into oxidant gas manifold 76 which, as stated, is in flow communication with a plurality of inlets 106 which form a ring around the outer surface of combined fuel-oxidant gas nozzle 42. Oxygen in manifold 76 enters outlets 106 and passes through the separate passages 104 such that oxygen discharges through outlets 100 at discharge face 98. At the same time, propylene passes through fuel gas passage 88 into fuel gas manifolds 74. Propylene enters inlets 110 of combined fuel-oxidant gas nozzle 42 and through passages 104 to outlets 102 of discharge face 98. Propylene and oxygen are thus flowing into passage 116 defined by barrel structure 80. The gases may be ignited by a number of means, such as a spark ignitor at outlet 150 of barrel structure 80.

Powder is supplied to the resulting combustion flame through feedstock delivery tube assembly 46 by way of a hose (not shown) which is connected at threads 53 and at its other end to a source of powder such as a hopper or the like. The powder is preferably carried using an inert carrier gas. Although a range of gas pressures may be used, in many applications, the oxygen gas pressure will be from between 7 bar to about 2 bar, the fuel gas pressure will be from between 4.5 bar to about 7 bar and the carrier gas pressure will be from between 4.5 bar to about 6 bar. Coolant, preferably water, is continuously circulated at a pressure of about 9 bar to about 3 bar in order to cool flame spray gun 20 as previously indicated.

As the feedstock powder moves through the flame created by combustion of the oxygen and fuel gases, it is heated to a temperature which is in part of function of the thermal characteristics of the material being sprayed. In addition, the combustion gases expand in passage 116 of barrel structure 80, propelling the molten or softened feedstock particles to velocities which may often may exceed 400 m/s. The resulting high velocity stream of heated particles issues from outlet 150 of barrel sructure 80 with good collumination and is then sprayed on a target substrate. High quality coatings have been formed in this manner as set forth more fully in the following description of test data.

Therefore, it will be appreciated that in addition to the novel flame spray gun 20, a method of flame spraying is provided by the present invention. Pursuant to this method, a fuel gas, an oxidant gas and a feedstock powder are discharged in a single plane, all having parallel trajectories, into a confined passage defined by barrel structure 80. In other words, fuel gas, oxidant gas, and powder pass through a single plane which is perpendicular to the gas and powder flow in the barrel. This technique has resulted in dense, adherent high quality coatings. In other words, fuel gas, oxidant gas, and powder pass through a single plane which is perpendicular to the gas and powder flow into the barrel.

EXAMPLES

The following actual tests were performed utilizing a flame spray gun having the general features described above. The combined fuel-oxidant gas nozzle used was that depicted in FIGS. 8 and 9, the expanded end-portion feature of the barrel shown in FIG. 10 was also utilized. The results tabulated below can be interpreted by the following key:

Powder number
Lot number DE = Deposition Efficiency
Composition
Parameter = oxygen/fuel/carrier gas
powder feed rate distance to target

| Powder | Lot No. | Composition | Parameter | Barrel Length (mm) 60 | 80 | 100 | Deposition Efficiency | Microhardness HVO.3 | Macrohardness R15N |
|---|---|---|---|---|---|---|---|---|---|
| 19155 | 180658 | TRIBALOY400 | 420/55/20 34 g/min d = 300 mm | | x | | 76% | 473 | 84.0 |
| 19155 | 180658 | TRIBALOY400 | 420/55/20 34 g/min d = 300 mm | x | | | 83% | 424 | 81.0 |
| CDS4603 | Hogenas | NiCrBSi | 420/55/20 60 g/min d = 300 mm | | | x | 63% | 776 | 89.0 |
| CDS4603 | Hogenas | NiCrBSi | 420/75/20 60 g/min d = 300 mm | | | x | 75% | 751 | 89.5 |
| CDS4603 | Hogenas | NiCrBSi | 420/55/20 60 g/min d = 300 mm | | x | | 68% | 710 | 86.0 |
| CDS4603 | Hogenas | NiCrBSi | 420/55/20 60 g min d = 300 mm | x | | | 68% | 754 | 86.0 |
| 1983 | 190388 | WC 17% Co. | 420/55/20 38 g/min d = 300 mm | | | x | 70% | 1107 | 88.5 |
| 1983 | 190388 | WC 17% Co. | 420/55/20 38 g/min d = 300 mm | | x | | Not measured | 1132 | 88.0 |
| 1983 | 190388 | WC 17% Co. | 420/55/20 38 g/min d = 300 mm | x | | | Not measured | 911 | 86.0 |
| 1983 | 190997 | WC 17% Co. | 420/55/20 d = 300 mm | | | x | Not measured | 1157 | 90.0 |
| 1927 | 201058 | WC 12% Co. | 420/55/20 40 g/min d = 300 mm | | | x | 77% | 1221 | 87 |
| 1927 | 201058 | WC 12% Co. | 420/55/20 40 g/min d = 300 mm | | x | | Not measured | 794 | 86.5 |
| 1927 | 201058 | WC 12% Co. | 420/55/20 40 g/min d = 300 mm | x | | | Not measured | 591 | 80 |
| 1927 | 190176 | WC 12% Co. | 420/55/20 45 g/min d = 300 mm | | | x | 74% | Not measured | Not measured |
| 1927 | 190176 | WC 12% Co. | 420/55/20 45 g/min d = 300 mm | | x | | 70% | Not measured | Not measured |
| 1927 | 190176 | WC 12% Co. | 420/55/20 45 g/min d = 300 mm | x | | | 64% | Not measured | Not measured |
| 1301 | 200740 | WC 12% Co. | 420/55/35 65 g/min d = 300 mm | | | x | 71% | 704 | 85.0 |
| 1301 | 200740 | WC 12% Co. | 420/55/35 65 g/min d = 300 mm | | x | | 57% | 590 | 82.5 |
| 1301 | 200740 | WC 12% Co. | 420/55/35 65 g/min d = 300 mm | x | | | 32% | 523 | 73.0 |
| 1718 | 180646 | INCONEL718 | 420/55/20 31 g/min d = 300 mm | | | x | 80% | 415 | 83.0 |
| 1718 | 180646 | INCONEL718 | 420/75/20 31 g/min d = 300 mm | | | x | 88% | 475 | 82.5 |
| 1718 | 180646 | INCONEL718 | 420/55/20 31 g/min d = 300 mm | | x | | 80% | 346 | 80.5 |
| 1718 | 180646 | INCONEL718 | 420/55/20 31 g/min d = 300 mm | x | | | 80% | 324 | 77 |
| 19155 | 180658 | TRIBALOY400 | 420/55/20 34 g/min d = 300 mm | | | x | 66% | 552 | 85.0 |
| 19155 | 180658 | TRIBALOY400 | 420/75/20 34 g/min | | | x | 70% | 566 | 86.0 |

-continued

Powder number
Lot number
Composition
Parameter = oxygen/fuel/carrier gas
powder feed rate distance to target
DE = Deposition Efficiency

| Powder | Lot No. | Composition | Parameter | Barrel Length (mm) 60 | 80 | 100 | Deposition Efficiency | Microhardness HVO.3 | Macrohardness R15N |
|---|---|---|---|---|---|---|---|---|---|
| | | | d = 300 mm | | | | | | |

Thus, it is apparent that there has been provided, in accordance with the invention, a method and apparatus that fully satisfies the objects, aims and advantages set forth above. While the invention has been described in connection with specific embodiments thereof, it is evident that many alternatives, modifications and variations will be apparent to those skilled in the art in light of the foregoing description. Accordingly, it is intended to embrace all such alternatives, modifications and variations that fall within the spirit and broad scope of the appended claims.

What is claimed is:

1. A thermal spray gun, comprising:

a gun body defining a substantially central bore;

a fuel/oxidant gas nozzle disposed in said central bore, said fuel/oxidant gas nozzle further defining a feedstock injection assembly receiving bore;

said fuel/oxidant gas nozzle defining a series of oxidant gas passages therethrough and a series of fuel gas passages therethrough;

said fuel/oxidant gas nozzle further having a substantially planar dicharging face at which said oxidant gas passages and said fuel gas passages terminate in a series of fuel gas outlets and oxidant gas outlets;

a powder feedstock injector assembly disposed within said substantially central bore and extending into said feedstock injector assembly-receiving bore;

a barrel disposed within said substantially central bore; and said barrel having a discharge end and an inlet end, wherein said inlet end is adjacent said discharge face of said fuel/oxidant gas nozzle.

2. The invention recited in claim 1, wherein said fuel gas outlets and said oxidant gas outlets are positioned on said discharge face to form a circle of said oxidant gas outlets and a circle of said fuel gas outlets, wherein the ring of centers of said oxidant gas outlets is displaced outwardly from the ring of centers of said fuel gas outlets.

3. The invention recited in claim 2, wherein the relative placement of said ring of oxidant gas outlets and said fuel gas outlets is such that a single circle can be drawn on said discharge face which intersects all of said oxidant outlets and all of said fuel gas outlets.

4. The invention recited in claim 1, wherein the diameter of each of said oxidant gas outlets is greater than that of each of said fuel gas outlets.

5. A thermal spray gun, comprising:

a gun body defining a substantially central bore;

a fuel/oxidant gas nozzle disposed in said central bore, said fuel/oxidant gas nozzle further defining a feedstock injection assembly receiving bore;

said fuel/oxidant gas nozzle defining a series of oxidant gas passages therethrough and a series of fuel gas passages therethrough;

said fuel/oxidant gas nozzle further having a substantially planar discharge face at which said oxidant gas passages and said fuel gas passages terminate in a series of fuel gas outlets and oxidant gas outlets;

a powder feedstock injector assembly disposed within said substantially central bore and extending into said feedstock injector assembly-receiving bore;

a barrel disposed within said substantially central bore;

said barrel having a discharge end and an inlet end, wherein aid inlet end is adjacent said discharge face of said fuel/oxidant gas nozzle; and wherein said fuel gas outlets and said oxidant gas outlets are positioned on said discharge face to form a circle of said oxidant gas outlets and a circle of said fuel gas outlets, wherein the ring of centers of said oxidant gas outlets is displaced outwardly from the ring of centers of said fuel gas outlets.

6. The invention recited in claim 5, wherein the relative placement of said ring of oxidant gas outlets and said fuel gas outlets is such that a single circle can be drawn on said dicharge face which intersects all of said oxidant outlets and all of said fuel gas outlets.

7. The invention recited in claim 5, wherein the diameter of each of said oxidant gas outlets is greater than that of each of said fuel gas outlets.

8. A thermal spray gun, comprising:

a gun body defining a substantially central bore;

a fuel/oxidant gas nozzle disposed in said central bore, said fuel/oxidant gas nozzle further defining a feedstock injection assembly receiving bore;

said fuel/oxidant gas nozzle defining a series of oxidant gas passages therethrough and a series of fuel gas passages therethrough;

said fuel/oxidant gas nozzle further having a substantially planar discgharge face at which said oxidant gas passages and said fuel gas passages terminate in a series of fuel gas outlets and oxidant gas outlets;

a powder feedstock injector assembly disposed within said substantially central bore and extending into said feedstock injector assembly-receiving bore;

a barrel disposed within said substantially central bore;

said barrel having a discharge end and an inlet end, wherein said inlet end is adjacent said discharge face of said fuel/oxidant gas nozzle; and wherein at least a portion of at least one of said fuel gas passages opens into said feedstock injector assembly-receiving bore.

9. The invention recited in claim 8, wherein a portion of all of said fuel gas passages open into said feedstock injector assembly-receiving bore.

10. The invention recited in claim 8, wherein said fuel gas outlets and said oxidant gas oulets are arranged on said disgharge face to form a circle of said oxidant gas outlets and a circle of said fuel gas outlets, wherein the ring of centers of said oxidant gas outlets is displaced outwardly from the ring of centers of said fuel gas outlets.

11. The invention recited in claim 8, wherein the diameter of each of said oxidant gas outlets is greater than that of each of said fuel gas outlets.

12. A thermal spray gun, comprising:

a gun body defining a substantially central bore;

a fuel/oxidant gas nozzle disposed in said central bore, said fuel/oxidant gas nozzle further defining a feedstock injector assembly-receiving bore;

said fuel/oxidant gas nozzle defining a series of oxidant gas passages therethrough;

said fuel/oxidant gas nozzle further having a discharge face at which said oxidant gas passages terminate in a series of oxidant gas outlets;

a powder feedstock injector assembly disposed within said substantially central bore and extending into said feedstock injector assembly-receiving bore;

a barrel disposed within said substantially central bore;

said barrel having a discharge end and an inlet end, wherein said inlet end is adjacent said discharge face of said fuel/oxidant gas nozzle; and wherein the relative positions of said powder feedstock injector assembly and said fuel/oxidant gas nozzle define a fuel annulus which terminates as a continuous ring at said discharge face.

13. A method of forming a thermal spray coating comprising the steps of:

providing a thermal spray gun having a gun body defining a substantially central bore;

flowing an oxidant gas and a fuel gas through a fuel-/oxident gas nozzle diposed in said central bore, said fuel/oxidant gas nozzle further defining a feedstock injection assembly-receiving bore;

said fuel/oxidant gas nozzle defining a series of oxidant gas passages therethrough and a series of fuel gas passages therethrough;

said fuel/oxidant gas nozzle further having a substantially planar discharge face at which said oxidant gas passages and said fuel gas passages terminate in a series of fuel gas outlets and oxidant gas outlets;

supplying a powder feedstock through a powder feedstock injector disposed within said substantially cental bore and extending into said feedstock injector assembly-receiving bore;

heating and accellerating said power feedstock in and through a barrel disposed within said substantially central bore;

said barrel having a discharge end and an inlet end, wherein said inlet end is adjacent said discharge face of said fuel/oxidant gas nozzle; and discharging said heated, accelerated feedstock onto a substrate to form a coating.

14. The invention recited in claim 1, wherein the internal diameter said discharge end of said barrel is greater than that of the portion of the barrel disposed between said discharge face of said fuel/oxidant gas nozzle and said discharge end.

15. The invention recited in claim 5, wherein the internal diameter said discharge end of said barrel is greater than that of the portion of the barrel disposed between said discharge face of said fuel/oxidant gas nozzle and said discharge end.

16. The invention recited in claim 8, wherein the internal diameter said discharge end of said barrel is greater than that of the portion of the barrel disposed between said discharge face of said fuel/oxidant gas nozzle and said discharge end.

17. The invention recited in claim 12, wherein the internal diameter said discharge end of said barrel is greater than that of the portion of the barrel disposed between said discharge face of said fuel/oxidant gas nozzle and said discharge end.

18. The invention recited in claim 13, wherein the internal diameter said discharge end of said barrel is greater than that of the portion of the barrel disposed between said dicharge face of said fuel/oxidant gas nozzle and said discharge end.

* * * * *

UNITED STATES PATENT AND TRADEMARK OFFICE

CERTIFICATE OF CORRECTION

PATENT NO. : 5,135,166

DATED : August 4, 1992

INVENTOR(S) : Dietiker, et al.

It is certified that error appears in the above-identified patent and that said Letters Patent is hereby corrected as shown below:

Column 12, line 21, "aid" should read "said".

Column 14, line 16, insert "of" before "said".

Column 14, line 21, insert "of" before "said".

Column 14, line 26, insert "of" before "said".

Column 14, line 31, insert "of" before"said".

Column 14, line 36, insert "of" before "said".

Signed and Sealed this

Fifteenth Day of March, 1994

*Attest:*

Bruce Lehman

BRUCE LEHMAN

*Attesting Officer*

*Commissioner of Patents and Trademarks*